United States Patent [19]

Lattion

[11] 4,140,286

[45] Feb. 20, 1979

[54] LOAD REDUCTION APPARATUS FOR A PIVOTAL BOBBIN SUPPORT ARM

[75] Inventor: André Lattion, Winterthur, Switzerland

[73] Assignee: Rieter Machine Works, Ltd., Winterthur, Switzerland

[21] Appl. No.: 812,805

[22] Filed: Jul. 5, 1977

[30] Foreign Application Priority Data

Jul. 22, 1976 [CH] Switzerland ..... 9380/76

[51] Int. Cl.[2] ..... B65H 54/42; B65H 54/52

[52] U.S. Cl. ..... 242/18 DD

[58] Field of Search ..... 242/18 DD, 18 B, 18 R, 242/65

[56] References Cited

U.S. PATENT DOCUMENTS

| | | | |
|---|---|---|---|
| 3,672,583 | 6/1972 | Harrison | 242/18 DD X |
| 3,672,584 | 6/1972 | Macedo et al. | 242/18 DD X |
| 3,991,950 | 11/1976 | Tashiro et al. | 242/18 DD |

FOREIGN PATENT DOCUMENTS

| | | | |
|---|---|---|---|
| 1862630 | 3/1962 | Fed. Rep. of Germany | 242/18 DD |
| 2217295 | 12/1972 | Fed. Rep. of Germany | 242/18 DD |
| 2146989 | 4/1973 | Fed. Rep. of Germany | 242/18 DD |

*Primary Examiner*—Stanley N. Gilreath

*Attorney, Agent, or Firm*—Kenyon & Kenyon, Reilly, Carr & Chapin

[57] ABSTRACT

A pivotal bobbin support arm is under the influence of two spring elements. A first spring element is used to initially bias the support arm towards a friction drive drum during an initial phase of winding of a bobbin package and to thereafter biasing the arm away from the drive drum during a later phase of winding. The second spring element is a load reducing element which is secured to either the support arm or a frame element of the machine. This load réducing element biases the support arm away from the drive drum to counteract the contacting pressure of the bobbin package on the drive drum during winding. The load reducing spring element may be of composite structure or may be in the form of a flat spring. In either case the spring element is constructed so as to be manually mounted and detached without the use of tools.

12 Claims, 6 Drawing Figures

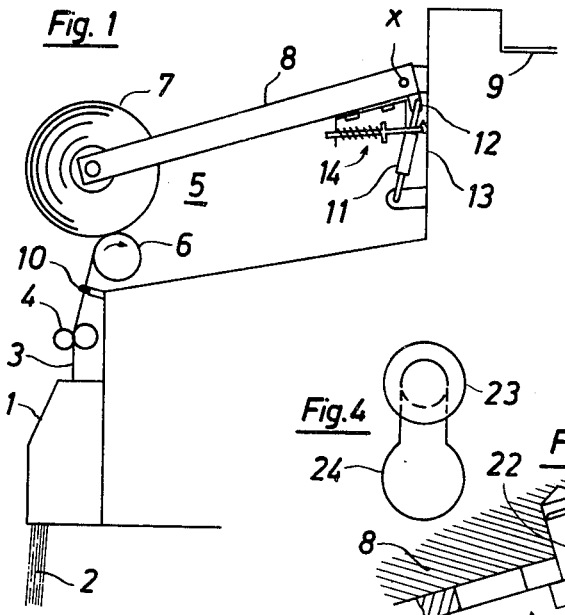
Fig. 1
x
8
7
9
12
14
5
11
13
6
10
4
3
1
2
Fig.4
23
24
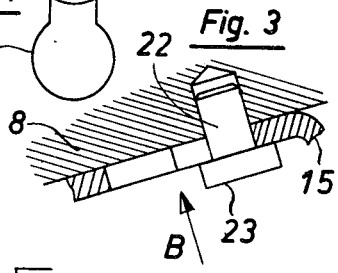
Fig. 3
22
8
15
B
23
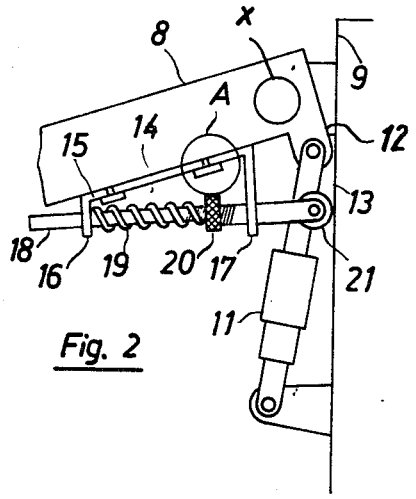
8
x
9
A
14
12
15
13
18
16
19
20
17
21
11
Fig. 2

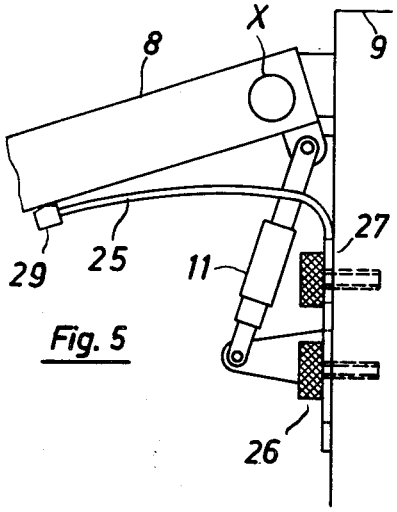
Fig. 5
Fig. 6
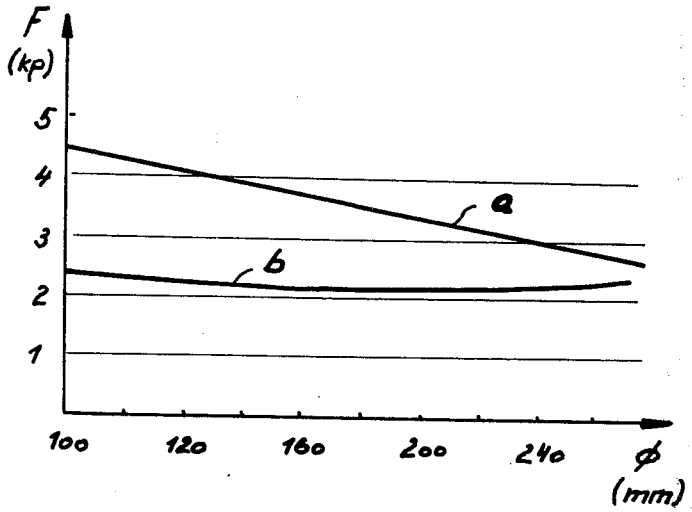

LOAD REDUCTION APPARATUS FOR A PIVOTAL BOBBIN SUPPORT ARM

This invention relates to a load reduction apparatus for a pivotal bobbin support arm. More particularly, this invention relates to a load reduction apparatus for a pivotal bobbin support arm of an open end spinning machine.

As is known, yarn or thread winding devices are usually constructed in such a manner that a bobbin package can build with a density which diminishes radially towards the outside. In order to achieve a bobbin package build of this type, a spring element has been used which acts upon the bobbin support arm so that the empty bobbin tube is initially pressed against a friction drive drum and, as the bobbin package weight increases, the spring force decreases to zero and then, during a second half of the package building process, counteracts the bobbin package weight. In this way, the weight of the bobbin package on the friction drive drum is reduced during the second half of the package building process.

Bobbin package building devices have also been used on open end spinning machines such as described in U.S. Pat. No. 3,991,950. In this case, two springs of different characteristics are coordinated in such a manner that the contacting pressure of the bobbin on the friction drive drum diminishes during the package build process. However, this device cannot be adapted to changing requirements. That is, once the contacting pressure is established, the pressure cannot be changed, for example for the occasional production of dyed bobbin packages.

Various building devices for an open-end spinning machine are also known to rely on the action of spring elements which are centrally adjustably for the entire machine. However, these devices do not achieve the desired result. This is due to the fact that although the spring element can be "softened" to initially reduce the high contacting pressure for example by reducing the pretension of the spring element, the increasing bobbin package weight can no longer be simultaneously compensated. As a consequence, "hard" winding layers occur at the end of the winding process.

As is known, a decreasing contact pressure between a bobbin and a drive drum is not suitable when producing a dyed bobbin package directly on an open-end spinning machine. This is because the inner winding layers are wound too tightly due to the high contacting pressure and prevent a good throughflow penetration of the dye liquid.

Accordingly, it is an object of the invention to provide a relatively simple apparatus for reducing the contacting pressure of a bobbin package on a friction drive drum during the initial phase of a bobbin package build such that a bobbin package for a dying process can be produced.

It is another object of the invention to provide a relatively simple device for winding a bobbin package of substantially constant density throughout.

It is another object of the invention to provide an apparatus for winding bobbin packages which can be adjusted.

It is another object of the invention to provide a winding apparatus for a bobbin package which can vary the contacting pressure of a bobbin package on a friction drive drum.

It is another object of the invention to provide an apparatus for adjusting the pressure of a bobbin package on a friction drive drum which can be mounted on existing machines.

It is another object of the invention to provide an apparatus for biasing a pivotal bobbin support arm against a friction drive drum which can be mounted in place without the use of tools.

It is another object of the invention to provide a load reducing apparatus which is of compact construction and which does not interfere with the operation and maintenance of a spinning machine.

Briefly, the invention provides a bobbin support arm which is pivotally mounted on the machine frame element for driving contact with a friction drive drum with two spring elements. A first spring element is secured between and to the machine element and the support arm for initially biasing the arm towards the drive drum during an initial phase of winding of a bobbin package and of thereafter biasing the arm away from the drive drum during a later phase of winding of the bobbin package. The second spring element is a load reducing element which is secured to one of the support arm and frame element and is pressed against the other of the support arm and frame element in order to bias the support arm away from the drive drum to counteract the contacting pressure of the bobbin package on the drive drum during winding.

In one embodiment the load reducing spring element includes a support which is secured to the support arm, a pressure rod which is slidably mounted in the support and a helical spring which biases the pressure rod against the machine frame element.

In another embodiment, the load reducing spring element is a flat spring which is secured to either of the support arm or machine frame element.

In both embodiments, the load reducing spring element is manually mountable or detachable without the use of tools.

The apparatus is particularly adaptable to open-end spinning machines which produce a continuous yarn. In this case, the yarn leaving a spinning unit of the machine is passed directly between a nip formed between the friction drive drum and the bobbin for winding into a bobbin package.

These and other objects and advantages of the invention will become more apparent from the following detailed description and appended claims taken in conjunction with the accompanying drawings in which:

FIG. 1 illustrates a side view of an open-end spinning machine with a load reducing spring element in accordance with the invention;

FIG. 2 illustrates an enlarged view of the load reducing spring element used in the structure of FIG. 1;

FIG. 3 illustrates an enlarged detail A of a means of mounting the load reducing spring element of FIGS. 1 and 2 on a support arm;

FIG. 4 illustrates a view taken in the direction of arrow B of FIG. 3;

FIG. 5 illustrates a modified load reducing spring element in accordance with the invention; and FIG. 6 illustrates a graphic representation of the characteristic of the contacting pressure of a bobbin package on a friction drive drum as a function of the bobbin package diameter with and without the use of a load reducing spring element in accordance with the invention.

Referring to FIG. 1, an open end spinning machine is provided with a plurality of open end spinning positions of known construction. Each spinning position is provided with a spinning unit 1 to which a staple fiber sliver 2 is supplied and from which a spun yarn 3 is taken off by a pair of rolls 4. In addition, each spinning position has a winding device 5 arranged above the spinning unit 1. This winding device 5 consists of a friction drive drum 6 which drives a cross-wound bobbin package 7, the package 7 is, in turn, rotatably clamped laterally at the front end of two bobbin support arms 8. The support arms 8 are each pivotally mounted about an axis X of the machine and permit the bobbin package 7 to rest in contacting manner on the drive drum 6. A traversing thread guide 10 is also used to guide the yarn 3 to and fro over the transverse length of the bobbin package 7.

Referring to FIGS. 1 and 2, a pressure spring element 11 is secured between and to a machine frame element 9 and a support arm 8 for initially biasing the arm 8 towards the drive drum 6. As shown, the spring element 11 acts upon a nose-shaped extension 12 on the end of the support arm 8 facing the machine outside the axis X. As shown, the extension 12 extends angularly from the support arm 8. As the bobbin package diameter increases, the load on the bobbin is reduced since the spring element 11, after passing through a labile dead-position, begins to counteract the increasing bobbin package weight.

In addition, a load reducing spring element 14 is secured to the support arm 8 between the arm 8 and a substantially vertical wall 13 of the machine frame element 9. This load reducing spring element 14 serves to bias the support arm 8 away from the drive drum 6 under a continuously decreasing force to counteract the contacting pressure of the bobbin package on the drive drum 6 during winding.

Referring to FIG. 2, the load reducing spring element 14 includes a support in the form of a U-shape hoop 15 having two legs 16, 17. In addition, the spring element includes a pressure rod 18 which is slidably mounted in the support legs 16, 17 and a helical pressure spring 19 which biases the pressure rod 18 against the machine frame element 9. As shown, the helical spring 19 is tensioned between one leg 16 and a set screw nut 20 threaded onto the pressure rod 18. This allows the tension in the spring 19 to be preset. By adjusting the nut 20, the amount of tension can be varied. In addition, a freely rotatable roll 21 is mounted on the end of the pressure rod 15 to reduce the friction against the wall 13 as the support arm 8 is pivoted. As shown, the vertical wall 13 acts as a stop relative to the pressure rod 18.

The hoop 15 is mounted on the support rod 8 in such a manner as to be detached without the use of tools. For example, as shown in FIGS. 3 and 4, a means is provided for mounting the spring element 14 in a manually detachably manner which includes a pair of pins 22 with enlarged heads 23 which are press fitted into the arm 8 via suitable bores. In addition, the support 15 is provided with two key hole shaped openings 24 which are stamped out. These openings 24 are sized to fit over the heads 23 of the pins 22 and to be slid under the heads 23 so as to fix the hoop 15 in place on the arm 8.

Referring to FIG. 5, the load reducing spring element may alternatively be constructed as a flat spring 25. As shown, the flat spring 25 is mounted on the machine frame element 9 via two set screws 26. In addition, the spring 25 is provided with two elongated slots 27 through which the set screws 26 pass so as to permit the position of the spring 25 to be adjusted. Any adjustment, simultaneously adjusts the action of the spring 25 on the support arm 8.

The free end of the flat spring 25 carries an end piece 29 made of an easily slidable material such as nylon. This end piece 29 is biased against the support arm 8 and is arranged in such a manner that the friction between the spring 25 and the support arm 8 is held to a minimum. If one flat spring 25 is not sufficient, a bundle of such springs can be used.

It is to be noted that the pressure spring element 14 as shown in FIGS. 1 and 2 may also be mounted on the machine frame element 9 instead of on the support arm 8. Likewise, the flat spring 25 of FIG. 5 can be mounted on the support arm 8 instead of on the machine frame element 9.

Referring to FIG. 6, a graphic representation of the contacting pressure F of a bobbin package on the friction drive drum 6 is indicated as a function of the package building process. The upper curve a represents the contacting pressure which normally prevails on an open end spinning machine. The contacting pressure F in this arrangement diminishes, for example from 4.3kp to 2.6kp; while the bobbin package diameter increases. However, by utilizing a load reduction spring element as described above in FIGS. 1 to 5, the contacting pressure F can be kept smaller and can be maintained approximately constant as indicated by curve b.

What is claimed is:

1. The combination of an open-end spinning machine for producing a continuous yarn;

a machine frame element;

a friction drive drum;

a bobbin support arm pivotally mounted on said machine frame element about a given axis for holding a bobbin package of the yarn in driving contact with said friction drive drum, said support arm having an extension extending angularly therefrom;

a first spring element secured between and to said machine frame element and said extension on one side of said axis for initially biasing said arm towards said drive drum during an initial phase or winding of a bobbin package and for thereafter biasing said arm away from said drive drum during a later phase of winding of the bobbin package; and a second load reducing spring element arranged between and secured to one of said support arm and said frame element and pressed against the other of said support arm and said frame element to bias said support arm away from said drive drum under a continuously decreasing force to counteract the contacting pressure of the bobbin package on said drive drum during winding, said second spring element acting on said support arm on an opposite side of said axis from said first spring element during said initial phase.

2. The combination as set forth in claim 1 wherein said load reducing spring element is adjustable to vary the biasing force on said support arm.

3. The combination as set forth in claim 1 wherein said second load reducing spring element is a flat spring sliding with one end on said support arm.

4. The combination of an open-end spinning machine for producing a continuous yarn;

a machine frame element;

a friction drive drum;

a bobbin support arm pivotally mounted on said machine frame element for holding a bobbin package of the yarn in driving contact with said friction drive drum;

a first spring element secured between and to said machine frame element and said support arm for initially biasing said arm towards said drive drum during an initial phase of winding of a bobbin package and for thereafter biasing said arm away from said drive drum during a later phase of winding of the bobbin package;

a load reducing spring element including a support secured to said support arm, a pressure rod slidably mounted in said support and a helical pressure spring secured between said support and said rod to bias said pressure rod against said machine frame element and to bias said support arm away from said drive drum via said support to counteract the contacting pressure of the bobbin package on said drive drum during winding; and means for mounting said load reducing spring on said support arm in a manually detachable manner.

5. The combination as set forth in claim 4 wherein said load reducing spring element further includes a set screw nut threaded on said pressure rod and disposed against one end of said spring for adjusting the force of said spring on said support arm.

6. The combination as set forth in claim 4 wherein said support is U-shaped with a pair of legs, said pressure rod being mounted in said legs with said spring secured to one of said legs.

7. The combination as set forth in claim 6 wherein said load reducing spring element further includes a set screw nut threaded on said pressure rod and said spring is disposed between one of said legs and said nut.

8. The combination of an open-end spinning machine for producing a continuous yarn;

a machine frame element;

a friction drive drum;

a bobbin support arm pivotally mounted on said machine frame element for holding a bobbin package of the yarn in driving contact with said friction drive drum;

a first spring element secured between and to said machine frame element and said support arm for initially biasing said arm towards said drive drum during an initial phase of winding of a bobbin package and for thereafter biasing said arm away from said drive drum during a later phase of winding of the bobbin package;

a load reducing flat spring secured to one of said support arm and said frame element and pressed against the other of said support arm and said frame element to bias said support arm away from said drive drum to counteract the contacting pressure of the bobbin package on said drive drum during winding, said spring having a pair of adjusting slots therein; and a pair of mounting elements on one of said support arm and said machine frame element received in said slots for mounting of said flat spring on said mounting elements.

9. The combination as set forth in claim 8 wherein said flat spring is shiftable relative to said mounting elements.

10. In combination with a bobbin support arm pivotally mounted on a machine frame element about a given axis for driving contact with a friction drive drum, said support arm having an extension extending angularly therefrom;

a first spring element secured between and to said machine frame element and said extension on one side of said axis for initially biasing said arm towards said drive drum during an initial phase of winding of a bobbin package and for thereafter biasing said arm away from said drive drum during a later phase of winding of the bobbin package; and a second load reducing spring element secured to one of said support arm and said frame element and pressed against the other of said support arm and said frame element to bias said support arm away from said drive drum under a continuously decreasing force to counteract the contacting pressure of the bobbin package on said drive drum during winding, said second spring element acting on said support arm on an opposite side of said axis from said first spring element during said initial phase.

11. The combination as set forth in claim 10 wherein said load reducing spring element is a flat spring.

12. In combination with a bobbin support arm pivotally mounted on a macihine frame element for driving contact with a friction drive drum, a first spring element secured between and to said machine frame element and said support arm for initially biasing said arm towards said drive drum during an initial phase of winding of a bobbin package and for thereafter biasing said arm away from said drive drum during a later phase of winding of the bobbin package;

a load reducing spring element including a support secured to said support arm, a pressure rod slidably mounted in said support and a helical pressure spring secured between said support and said rod to bias said pressure rod against said machine frame element and to bias said support arm away from said drive drum via said support to counteract the contacting pressure of the bobbin package on said drive drum during winding; and means for mounting said load reducing spring element on said support arm in a manually detachable manner.

* * * * *